US007901332B1

(12) United States Patent
Wen

(10) Patent No.: US 7,901,332 B1
(45) Date of Patent: Mar. 8, 2011

(54) MULTI-FUNCTION EXERCISE EQUIPMENT

(76) Inventor: Shoi-Lien Wen, Taichung (TW)

( * ) Notice: Subject to any disclaimer, the term of this patent is extended or adjusted under 35 U.S.C. 154(b) by 0 days.

(21) Appl. No.: 12/801,093

(22) Filed: May 21, 2010

(51) Int. Cl.
*A63B 22/04* (2006.01)
*A63B 21/00* (2006.01)

(52) U.S. Cl. ..... 482/52; 482/53; 482/51

(58) Field of Classification Search ..... 482/51–53, 482/57, 70, 79–80, 148
See application file for complete search history.

(56) References Cited

U.S. PATENT DOCUMENTS

| | | | | | |
|---|---|---|---|---|---|
| 4,781,372 | A * | 11/1988 | McCormack | 482/70 |
| 5,078,390 | A * | 1/1992 | Hurt | 482/53 |
| 5,195,935 | A * | 3/1993 | Fencel | 482/70 |
| 5,242,340 | A * | 9/1993 | Jerome | 482/52 |
| 5,279,529 | A * | 1/1994 | Eschenbach | 482/57 |
| 5,299,992 | A * | 4/1994 | Wilkinson | 482/52 |
| 5,314,392 | A * | 5/1994 | Hawkins et al. | 482/57 |
| 5,503,609 | A * | 4/1996 | Bull | 482/70 |
| 5,792,029 | A * | 8/1998 | Gordon | 482/52 |
| 5,897,459 | A * | 4/1999 | Habing et al. | 482/53 |
| 5,910,072 | A * | 6/1999 | Rawls et al. | 482/51 |
| 6,004,244 | A * | 12/1999 | Simonson | 482/52 |
| 6,126,573 | A * | 10/2000 | Eschenbach | 482/51 |
| 6,190,289 | B1 * | 2/2001 | Pyles et al. | 482/52 |
| 6,468,184 | B1 * | 10/2002 | Lee | 482/52 |
| 6,595,899 | B2 * | 7/2003 | Liang | 482/53 |
| 6,709,367 | B1 * | 3/2004 | Liang | 482/53 |
| 6,712,739 | B1 * | 3/2004 | Chen | 482/53 |
| 6,997,854 | B2 * | 2/2006 | Yang | 482/53 |
| 7,048,675 | B1 * | 5/2006 | Liang | 482/53 |
| 7,497,808 | B2 * | 3/2009 | Eschenbach | 482/52 |
| 7,530,928 | B2 * | 5/2009 | Liao | 482/53 |
| 7,582,043 | B2 * | 9/2009 | Liao et al. | 482/52 |
| 7,637,848 | B1 * | 12/2009 | Chang | 482/51 |
| 7,654,936 | B2 * | 2/2010 | Liao et al. | 482/52 |
| 7,682,290 | B2 * | 3/2010 | Liao et al. | 482/52 |
| 7,736,278 | B2 * | 6/2010 | Lull et al. | 482/52 |
| 7,775,941 | B2 * | 8/2010 | Nguyen et al. | 482/52 |
| 2004/0214693 | A1 * | 10/2004 | Piaget et al. | 482/52 |
| 2005/0070403 | A1 * | 3/2005 | Yu | 482/53 |
| 2006/0073942 | A1 * | 4/2006 | Yang | 482/53 |
| 2007/0238582 | A1 * | 10/2007 | Lee | 482/52 |
| 2007/0270284 | A1 * | 11/2007 | Lin | 482/52 |
| 2008/0026916 | A1 * | 1/2008 | Chuang et al. | 482/53 |
| 2008/0312045 | A1 * | 12/2008 | Lull et al. | 482/52 |
| 2010/0093498 | A1 * | 4/2010 | Fenster et al. | 482/52 |

* cited by examiner

*Primary Examiner* — Steve R Crow

(57) ABSTRACT

A multi-function exercise equipment is revealed. The exercise equipment includes a base and two track grooves connected by left and right links, lower links and cylinders. A pedal is mounted in each track groove and at least one locating hole is arranged at the track groove. The pedal is disposed with a locking rod that is matched to the locating hole. Moreover, at least one stop hole is set on the left link while a latch is disposed on the right link and is mounted in the stop hole. After the locking rod mounted into the locating hole and the latch mounted into the stop hole, the pedals are moved up and down synchronously. After the locking rod and the latch being released, the track grooves are parallel to a horizontal plane or inclined. The pedals slide back automatically so that users can push feet out and return.

10 Claims, 11 Drawing Sheets

MULTI-FUNCTION EXERCISE EQUIPMENT

BACKGROUND OF THE INVENTION

1. Fields of the Invention

The present invention relates to an exercise equipment, especially to a multi-function exercise equipment that enables users stepping and stretching their feet.

2. Descriptions of Related Art

There are various types of exercise equipment available now. One of them is a stretcher. Two long seats are pivotally connected with two ends of a handle symmetrically. A wheel set covered with a housing is arranged symmetrically on two shorts sides of the long seat. A guiding slot is set on an edge of each of two long sides on a top surface of the long seat. Two pedals, each having at least two sets of symmetrical casters on bottom thereof, are respectively mounted in the symmetrical guiding slots. Two sets of symmetrical locking slots are arranged on two sides of a top end of the pedal respectively. A plurality of elastic cables is disposed in the long seat. The elastic cable is wound around the wheel set and a stopper is connected to a rear end of the elastic cable for being stopped over the housing or being mounted in the locking slot. The stretcher features on that: a long groove is disposed on top of the long seat, between the symmetrical guiding slots and a plurality of symmetrical equal-spaced locating holes is arranged near an outer side of the two long grooves. A stop base is disposed with pins on four corners of the bottom thereof while the four pins are mounted into the locating holes bear the long grooves. By adjusting the positions of the pins of the stop base, mounted into different locating holes, the distance of the pedal moving in the guiding slot is changed. However, the exercise equipment provides only one exercise mode.

Thus there is a need to improve the exercise equipment so that the exercise equipment is not only for feet stretching exercise but is also shifted to stepping exercise.

SUMMARY OF THE INVENTION

Therefore it is a primary object of the present invention to provide a multi-function exercise equipment that make users get stepping exercise and stretching exercise. By a shift unit, the exercise mode is changed. Thus users can have different exercise modes.

In order to achieve the above object, a multi-function exercise equipment of the present invention mainly includes a base, two track grooves, and two pedals. The base is disposed with an upper shaft and two lower shafts while the pedal is mounted in each of the two track grooves. At least one locating hole is arranged at an inner surface of the bottom of the track groove. An outer surface of the bottom of one track groove is pivotally connected to a left link and a lower link while the other track groove is similarly pivotally connected to a right link and a lower link. The other end of the left link and the other end of the right link are pivotally connected to the upper shaft while the other end of each of the two lower links is pivotally connected to each of the two lower shafts correspondingly. The left link is disposed with at least one stop hole while the right link is arranged with a latch that is matched to the stop hole. The bottom of the pedal is pivotally connected with two pulley sets against an inner surface of the bottom of the track groove and is arranged with a locking rod that is mounted into the locating hole. The two pedals are moved up and down synchronously by mounting the locking rod into the locating hole and the latch into the stop hole. After the locking rod and the latch being released from the corresponding hole, the pedals slide freely in the track grooves.

Moreover, a cylinder is disposed between the bottom of the two lower shafts of the base and the outer surface of the bottom of the two track grooves for providing resistance while the pedals are pressed so as to build foot strength.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
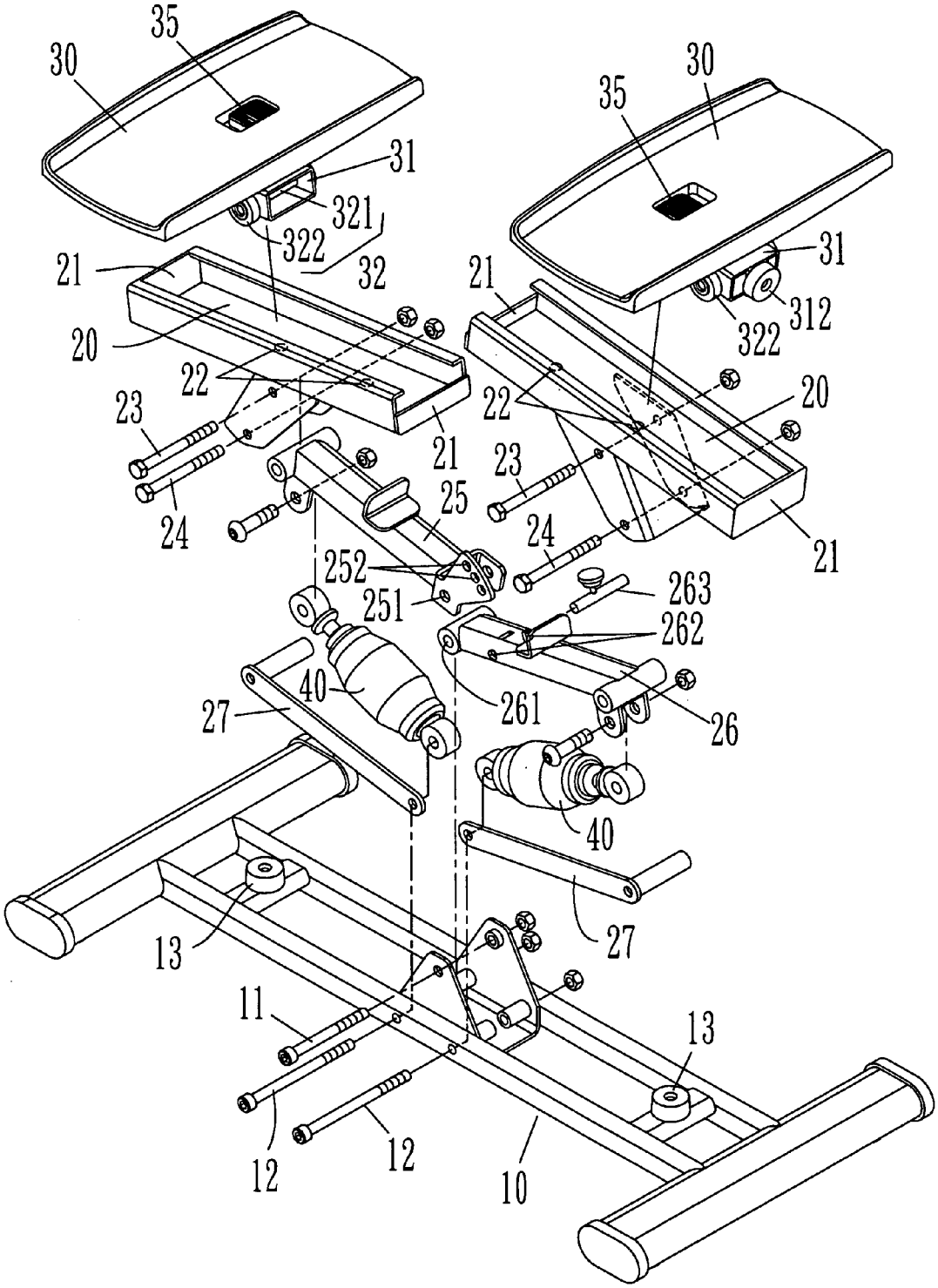
FIG. 1 is an explosive view of an embodiment according to the present invention.

Refer to FIG. 1, a multi-function exercise equipment of the present invention includes a base 10, two track grooves 20, two pedals 30 and two cylinders.

The base 10 is disposed with an upper shaft 11 and two lower shafts 12. The two lower shafts 12 are respectively arranged at an outer side of the base 10 under the upper shaft 11, opposite to each other.

The two track grooves 20 are long depression, symmetrical to each other. A stopping part 21 is disposed on each of two short sides of the track groove 20, a pedal 30 is mounted in the track groove 20 and at least one locating hole 22 is arranged at an inner surface of the bottom of the track groove 20. In this embodiment, there are two locating holes 22 spaced a certain distance apart. Moreover, an outer surface of the bottom of the track groove 20 is arranged with an upper shaft and a lower shaft 23, 24 that are respectively pivotally connected to a left link 25 and a lower link 27. An outer surface of the bottom of the other track groove 20 is similarly disposed with another set of upper and lower shafts 23, 24 that are respectively pivotally connected to a right link 26 and a lower link 27. The other end of the left link 25 and the other end of the right link 26 are pivotally connected to the upper shaft 11 while the other end of each of the two lower links 27 is pivotally connected to each of the two lower shafts 12 correspondingly.

Figure 8:
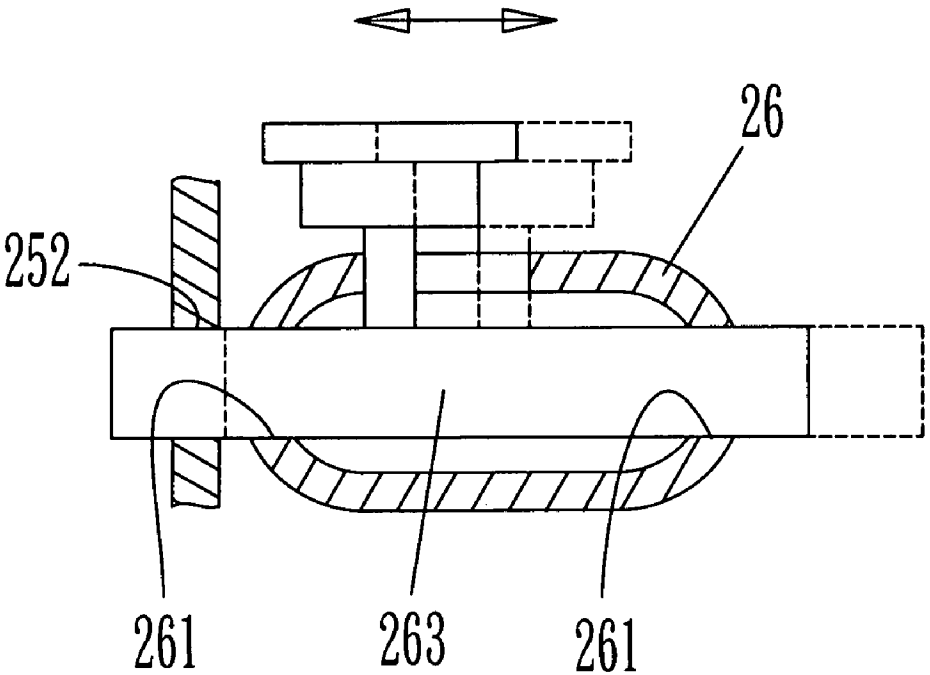
FIG. 8 is a cross sectional view of the embodiment along a line B-B in FIG. 7.
Figure 5:
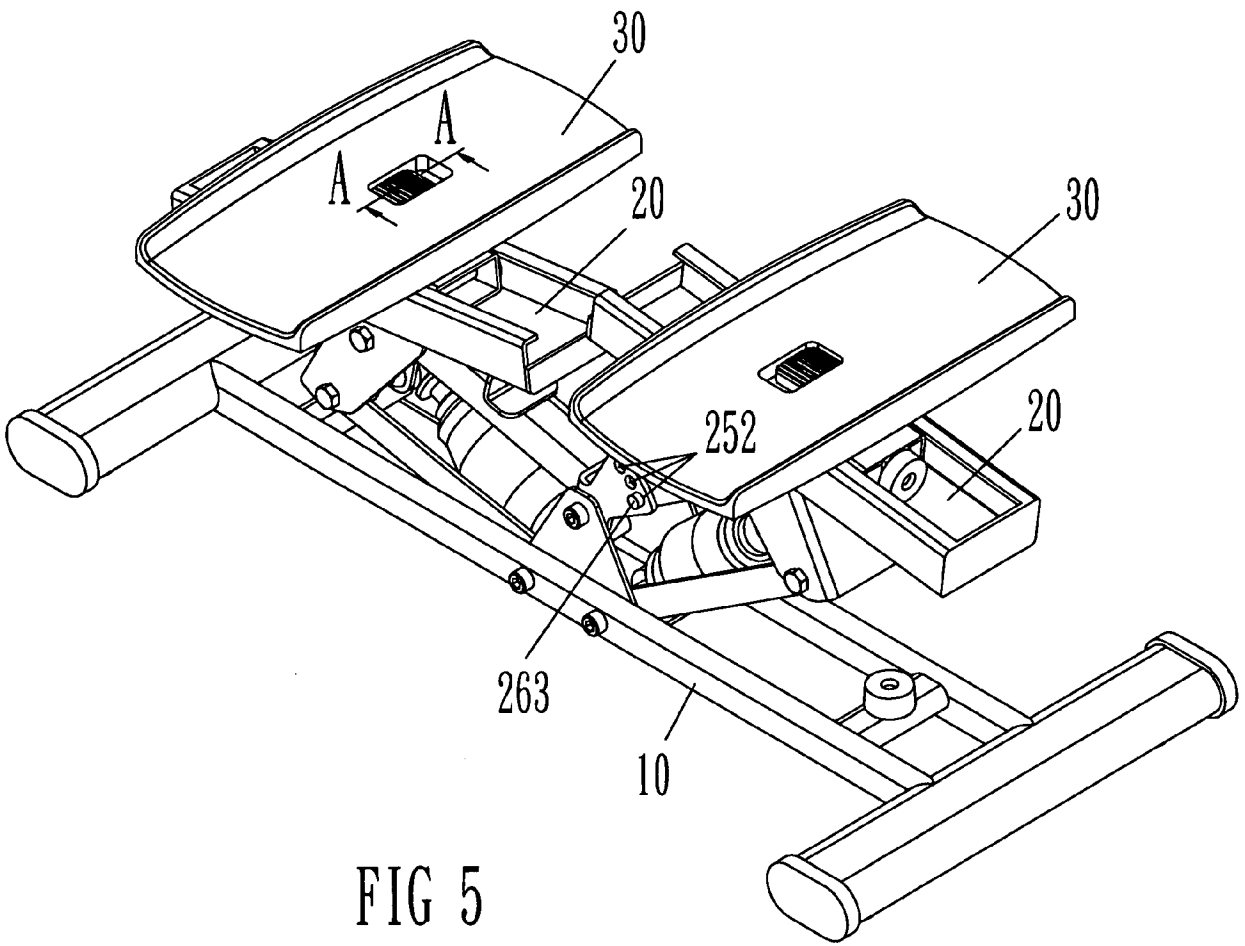
FIG. 5 is a perspective view of the assembled embodiment in FIG. 1.

Furthermore, refer to FIG. 1, FIG. 5 and FIG. 8, a lower-left hole 251 for being inserted and connected pivotally by the upper shaft 11 is disposed on one end of the left link 25 and at least one stop hole 252 is arranged around the lower-left hole 251 that is a center of rotation. In this embodiment, there are three stop holes 252. A lower-right hole 261 for being inserted and connected pivotally by the upper shaft 11 is disposed on one end of the right link 26 and an insertion hole 262 is also arranged at the right link 26, beside and parallel to the lower-right hole 261. While adjusting the movement of the right link 26, the insertion hole 262 is corresponding to one of the above three stop holes 252. A latch 263 is mounted in the insertion hole 262 and one end of the latch 263 is mounted into or released from the corresponding stop hole 252 according to users' needs.

Figure 2:
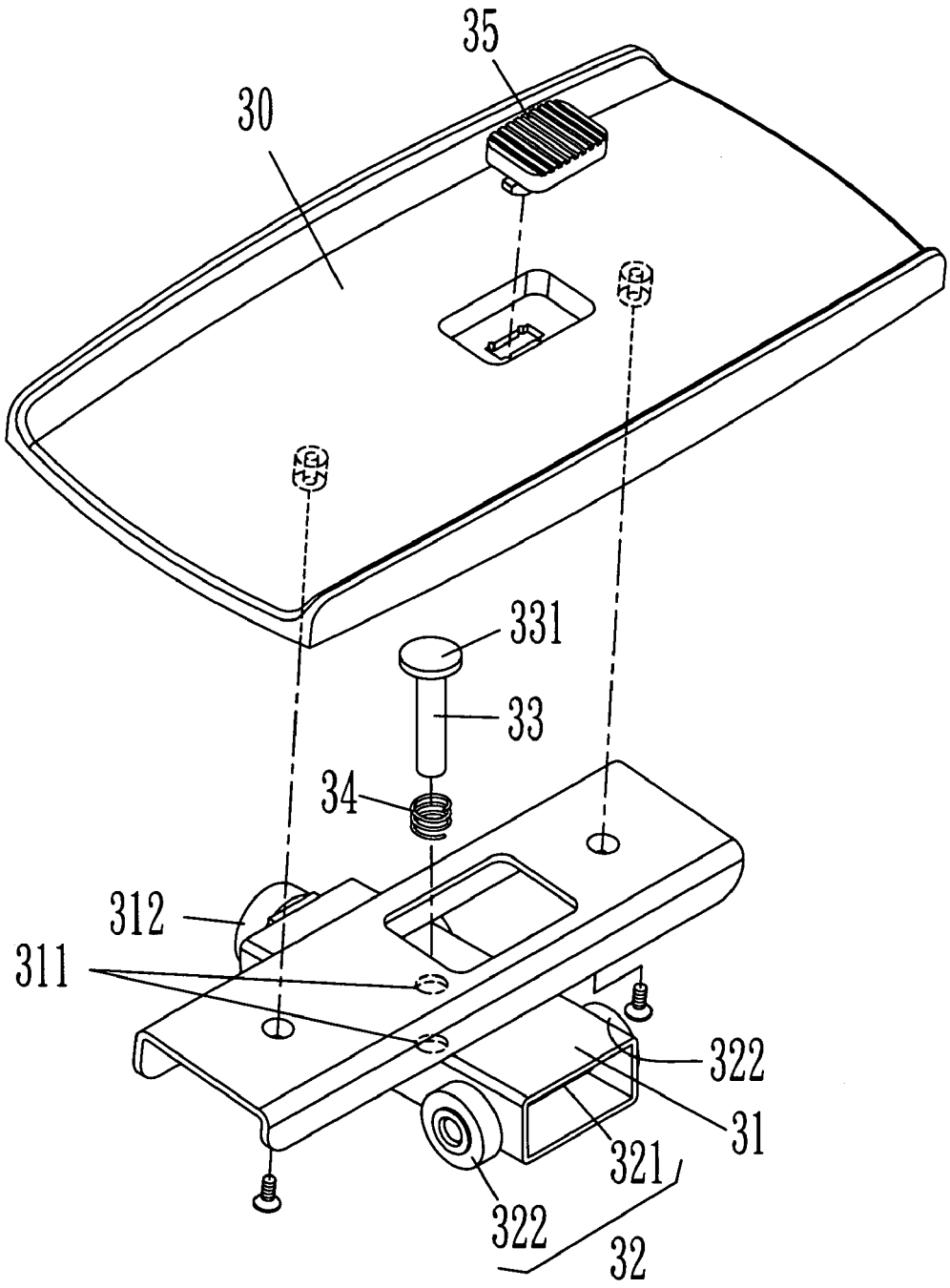
FIG. 2 is an explosive view of a pedal of an embodiment according to the present invention.
Figure 3:
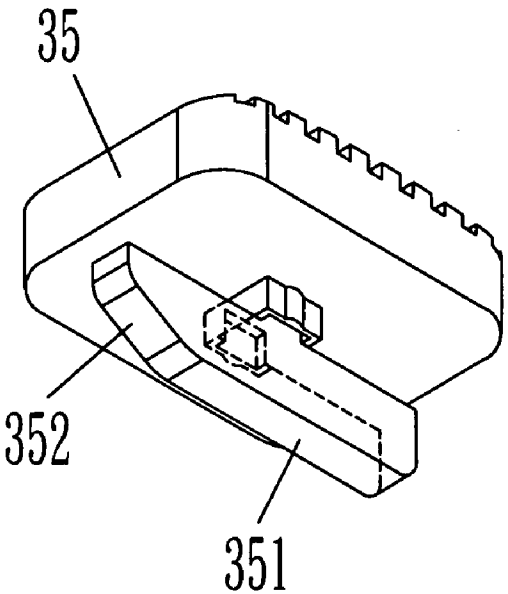
FIG. 3 is a bottom view of a sliding block on top of a pedal of an embodiment according to the present invention.
Figure 4:
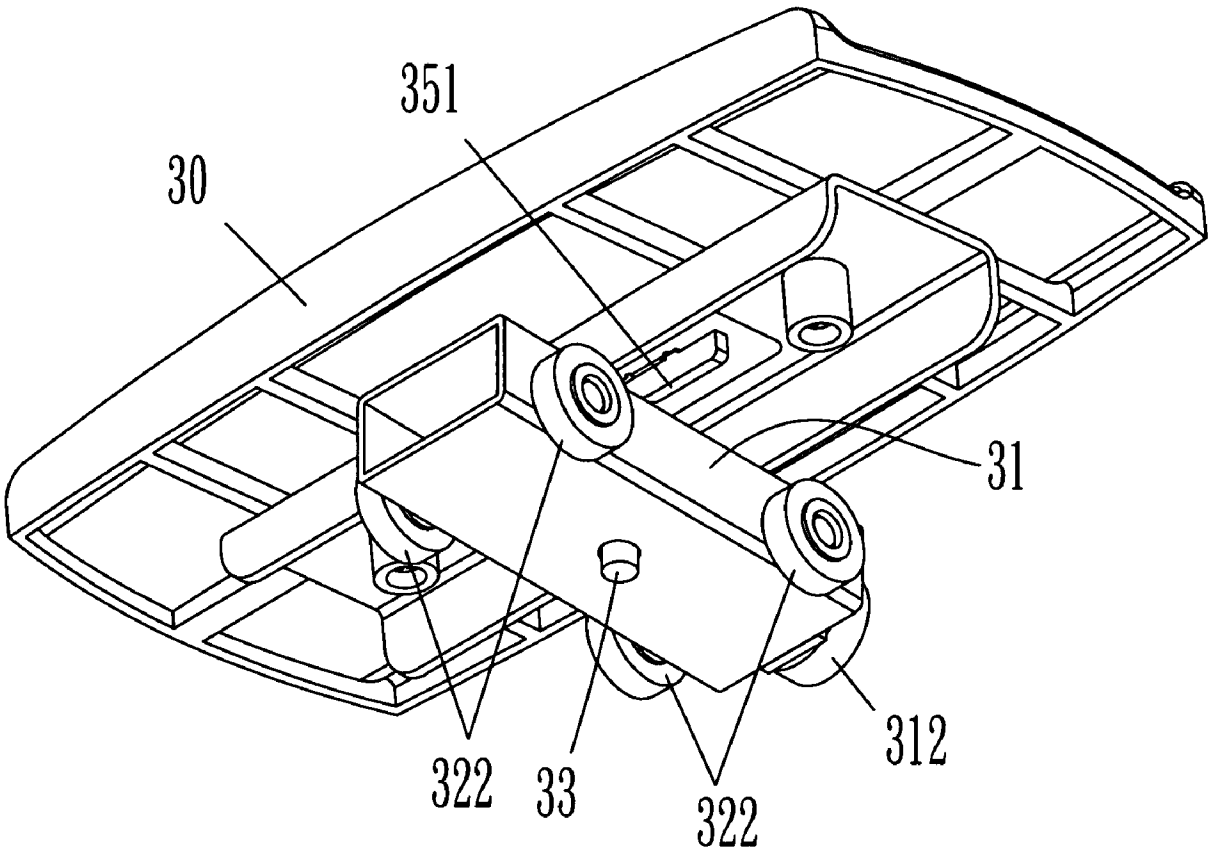
FIG. 4 is a bottom view of the assembled embodiment in FIG. 2.

Refer to FIG. 2 and FIG. 4, a socket 31 is connected on the bottom of the pedal 30 and a pulley set 32 is pivotally connected to a front part as well as a rear part of the socket 31. Each pulley set 32 consists of a horizontal shaft 321 and two pulleys 322 that are respectively disposed on two outer sides of the socket 31. The pulley 322 whose bottom is lower than the bottom of the socket 31 is contacted with the inner surface of the track groove 20 and is rolling smoothly therein.

Figure 6:
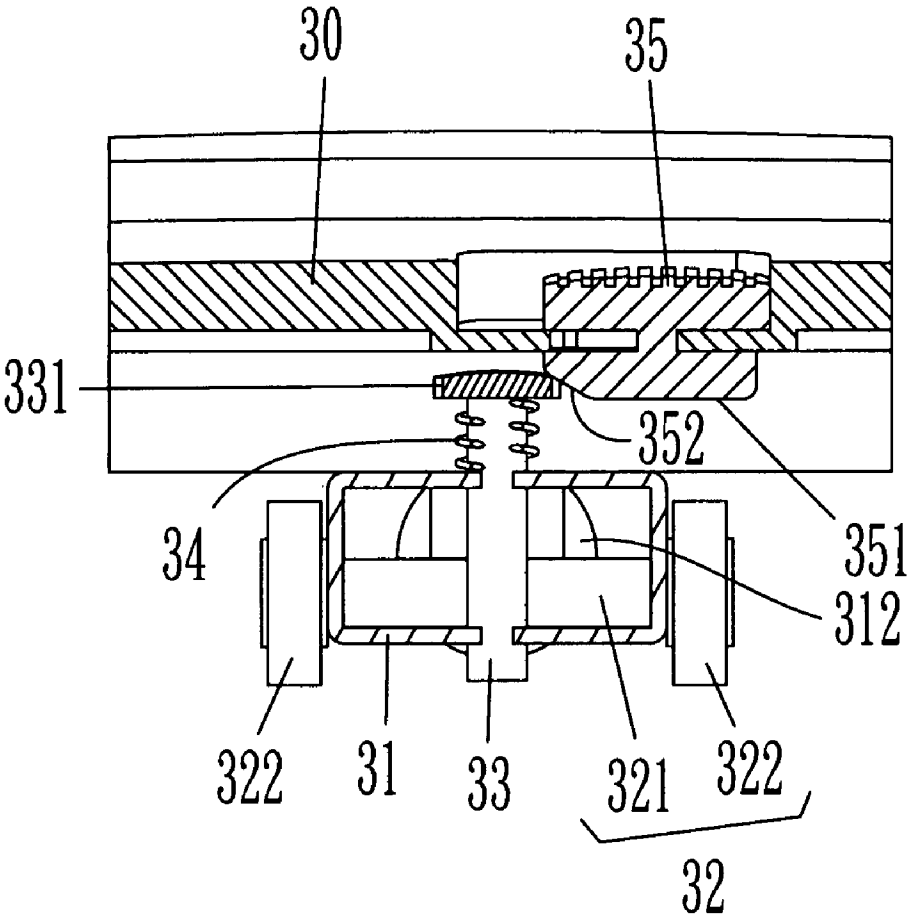
FIG. 6 is a cross-sectional view of the embodiment along a line A-A in FIG. 5.

The socket 31 on the pedal 30 is mounted with a locking rod 33 that can be moved vertically. The locking rod 33 having a flange head 331 and the locating hole 22 are matched correspondingly. In this embodiment, as shown in FIG. 2 and FIG. 6, the socket 31 is arranged with a through hole 311 so that the locking rod 33 is mounted in the through hole 311. An elastic element 34 such as a compression spring whose two ends are respectively against the flange head 331 and a top surface of the socket 31 is arranged around the locking rod 33. An adjustable and movable sliding block 35 with a downward slant 352 on one end of a bottom surface 351 thereof is set on the pedal 30, corresponding to the through hole 311. Generally, the elastic element 34 keeps pushing the flange head 331 to move upward. As shown in FIG. 6, when the top of the flange head 331 contacts the downward slant 352 of the sliding block 35, the bottom of the locking rod 33 is completely released from the locating hole 22 of the track groove 20. While moving the sliding block 35 so as to make the other end of the bottom surface 351 opposite to the downward slant 352 contact the top surface of the flange head 331, the flange head 331 is pressed down so that the bottom of the locking rod 33 is mounted into the locating hole 22 and the pedal 30 is static in the track groove 20.

In accordance with above structure, after the locking rod 33 being mounted into the locating hole 22, the pedal is fixed in a certain position of the track groove 20 and is in a static state. Then one end of the latch 263 is mounted into one of the stop holes 252 so as to connect the left link 25 and the right link 26 in series. Thereby the feet swing upward and downward synchronously when the two pedals 30 are pressed by feet one after the other and moving up and down so that users can step on the exercise equipment to train their bodies for improving health and fitness.

When the exercise equipment of the present invention is adjusted to work like a stepper, the height difference between the two pedals 30 is changed by mounting one end of the latch 263 into the stop holes 252 at different height so as to have different exercise modes such as different class levers that provide increases or decreased in force. For example, refer to FIG. 7, when one end of the latch 263 is mounted into the stop hole 252 at the highest position, a smaller angle formed between the left link 25 and the right link 26. Under such condition, the locking rods 33 of the pedals 30 are respectively mounted into the locating holes 22 on the inner side of the two track grooves 20, closest to each other, the distance between the two pedals 30 is the shortest and the height difference of the steps is maximum. This requires more effort to push the pedals. When the locking rods 33 of the pedals 30 are respectively mounted into the locating holes 22 on the outer side of the two track grooves 20, farthest from each other, the distance between the two pedals 30 is increased and the height difference of the steps is reduced a bit. This mode is more labor saving than the above mode.

Figure 7:
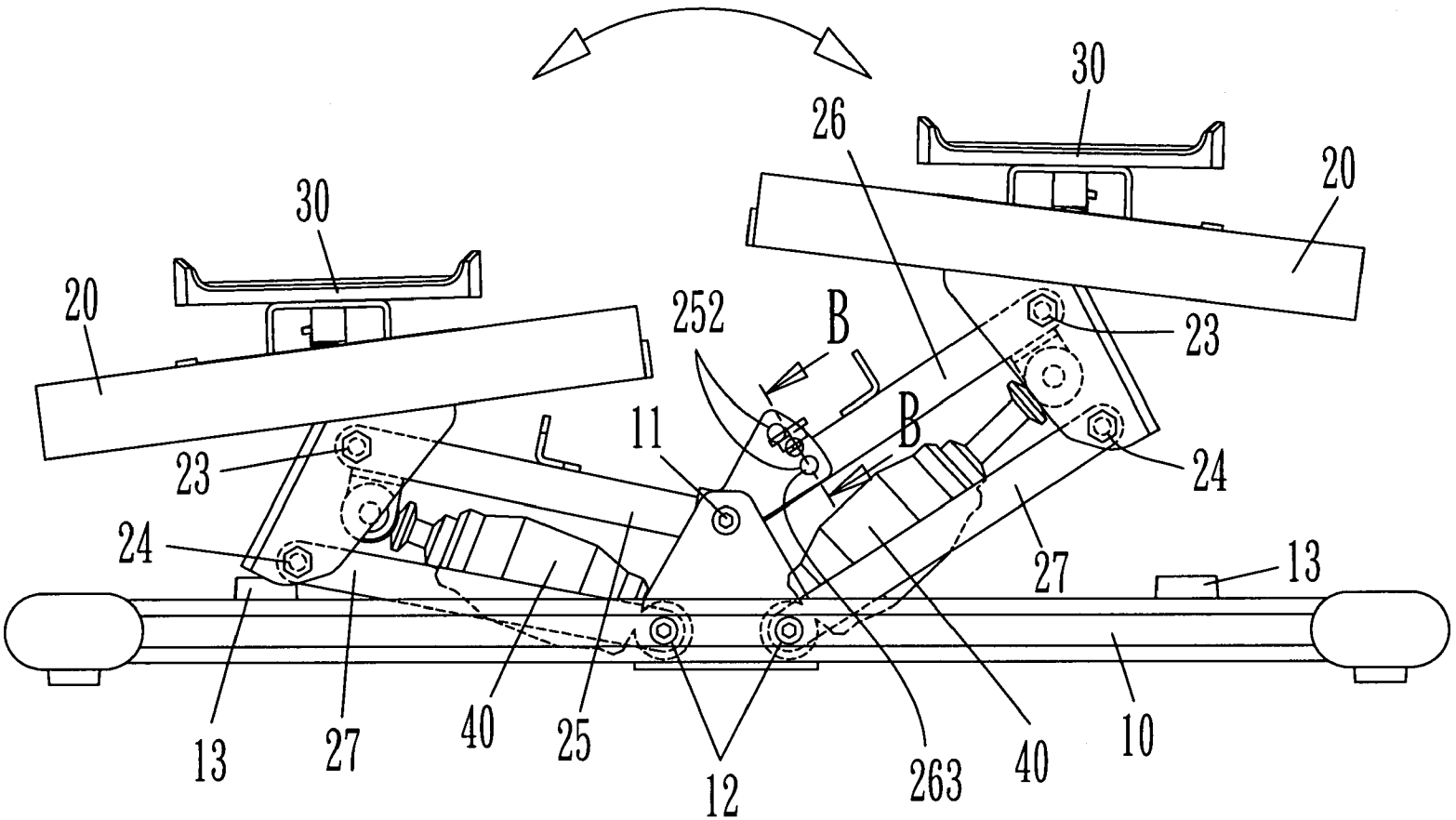
FIG. 7 is a front view of the assembled embodiment in FIG. 1.

Refer to FIG. 7, while mounting one end of the latch 263 into the stop hole 252 at the lowest position, a largest angle formed between the left link 25 and the right link 26. Under such condition, if the locking rods 33 of the pedals 30 are mounted into locating holes 22 on the inner or the outer side (different positions) of the two track grooves 20, the distance between the two pedals 30 is changed and adjustable. Thus the equipment can be shifted to different exercise mode as mentioned above.

The height difference between the two pedals 30 is adjustable by mounting the latch 263 into the stop hole 252 at different positions. Moreover, the distance between the two pedals 30 can also be changed by mounting the locking rod 33 of the pedal 30 into the locating hole 22 at different positions.

After the multi-function exercise equipment of the present invention being adjusted to be a stepper, one cylinder 40 is disposed between the bottom on the outer side of the left link 25 and the lower shaft 12 of the base 10, while the other cylinder 40 is between the bottom on the outer side of the right link 26 and the lower shaft 12 of the base 10 so as to provide resistance while pressing the pedals 30. Moreover, the two cylinders 40 can also be connected pivotally under the outer surface of the bottom of the track grooves 20 so as to produce resistance during the pressing of the pedals 30.

Figure 9:
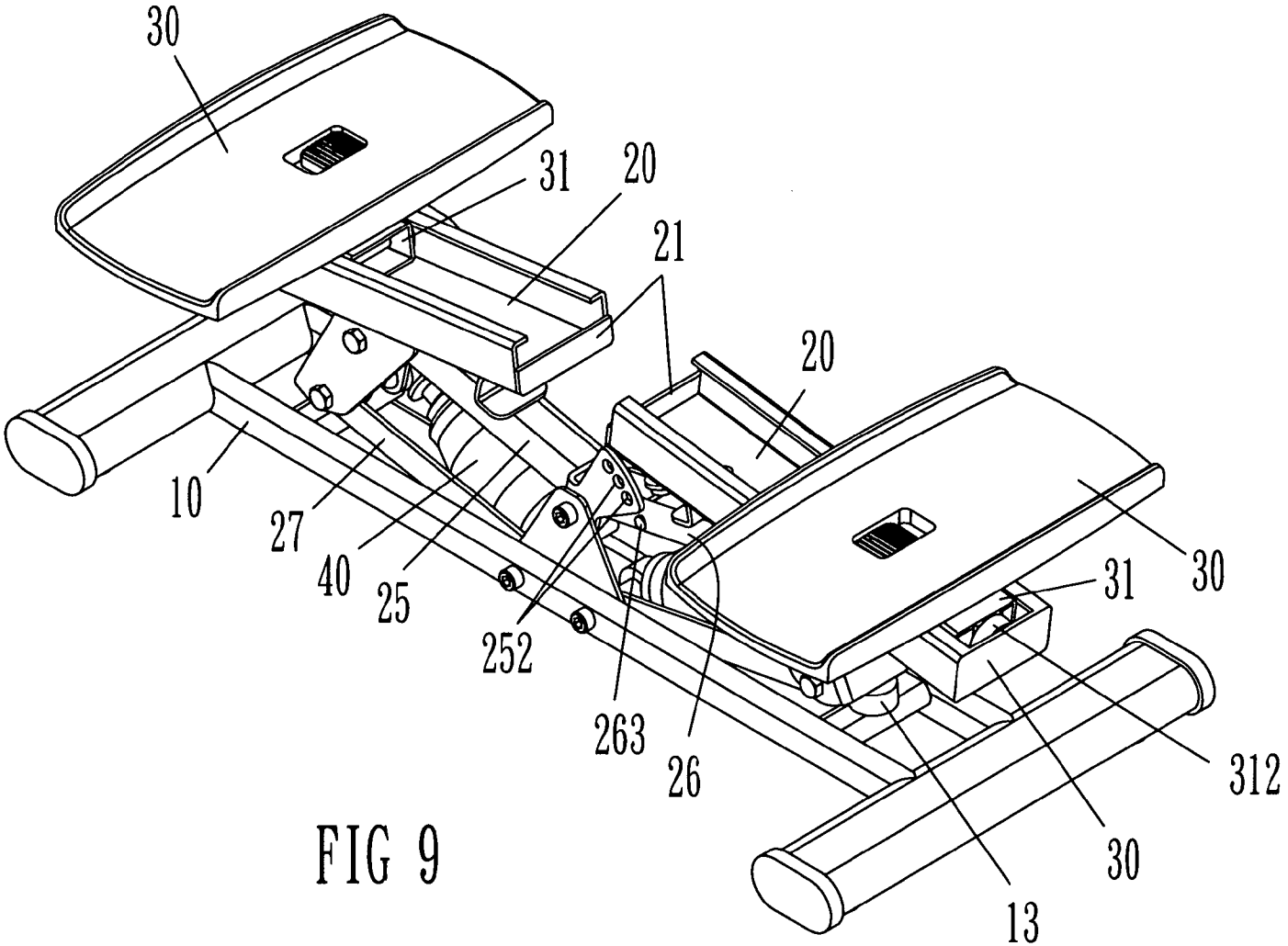
FIG. 9 is a perspective view of an embodiment shifted to another mode according to the present invention.
Figure 10:
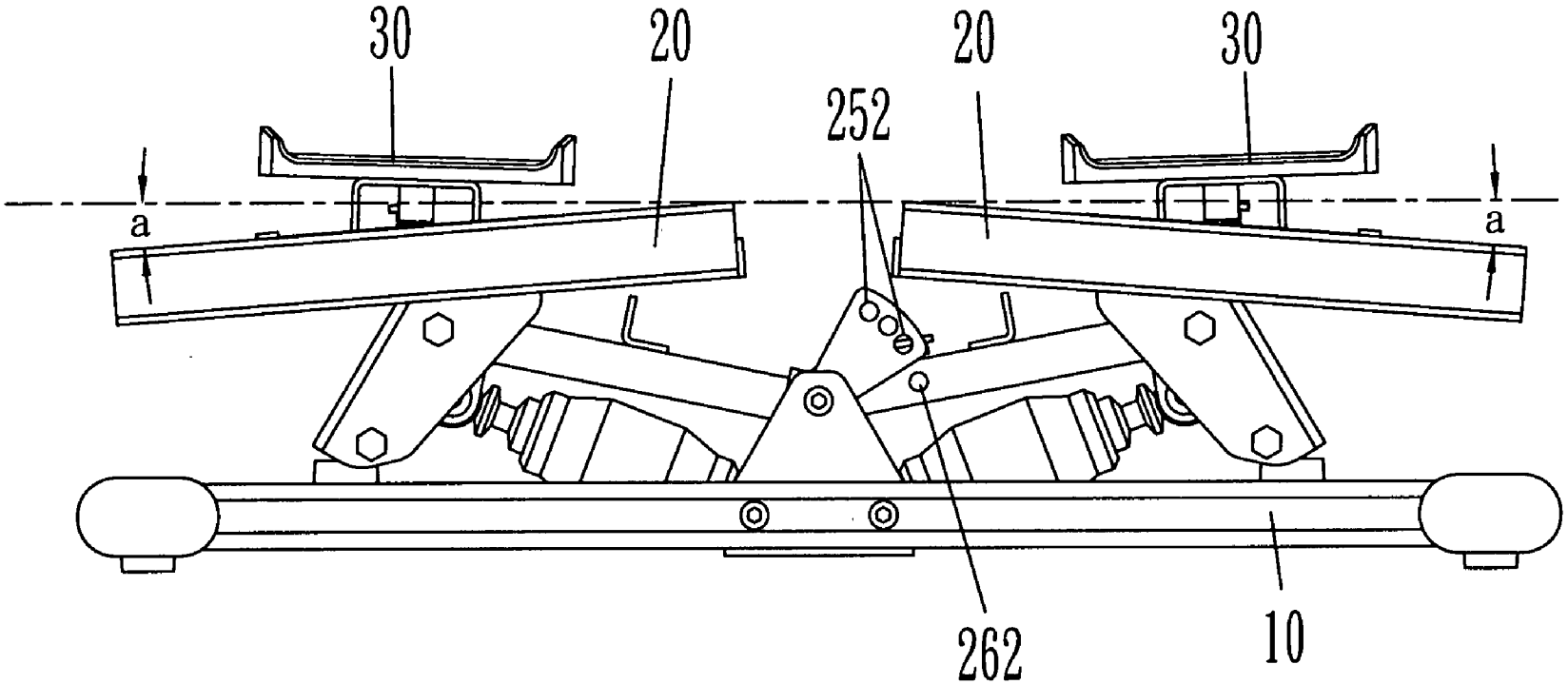
FIG. 10 is a front view of the embodiment in FIG. 9.

Refer to FIG. 9 and FIG. 10, a multifunction exercise equipment of the present invention is shifted to another mode for users to push feet outward and return. After one end of the latch 263 being released from the stop hole 252, the left link 25 and the right link 26 are separated from each other and moving independently. Moreover, the bottom of the locking rod 33 is adjusted to be out of the locating hole 22 of the track groove 20 so that the pedal 30 moves freely along a preset path in the track groove 20. Thereby after the two track grooves 20 being pressed down and the left link 25 and the right link 26 being extended to the maximum, the two track grooves 20 are parallel to a horizontal plane or inclined downward from an inner side to an outer side thereof. Thus the pedal 30 slips and leans against the lowest position of the inclined track groove 20. Due to this feature, when the two pedals 30 are moving toward an inner side and getting closer to each other, the pedals 30 slide back to the lowest position automatically once the load on the pedals 30 is removed. Therefore, users can stretch their feet more smoothly.

When the exercise equipment of the present invention is adjusted to the feet stretch mode, an elastic pad 312 is arranged at one end of the socket 31, facing the stopping part 21 of the track groove 20 so as to prevent noises and vibrations caused by contact between the socket 31 and the stopping part 21 of the track groove 20. The elastic pad 312 can also be disposed on an inner side of each stopping part that faces each other (not shown in figure). In this embodiment, an elastic pad 312 is fixed on one end of the socket 31. The elastic pad 312 is made from plastic foam or other materials with similar functions.

Moreover, an elastic member 13 is arranged at each of two sides of the base 10 symmetrically and is used for against the outer surface of the bottom of the track groove 20. While the elastic members 13 contacting with the outer surface of the bottom of each track groove 20, the elastic member 13 provides buffer action, reducing noises and vibration.

Figure 11:
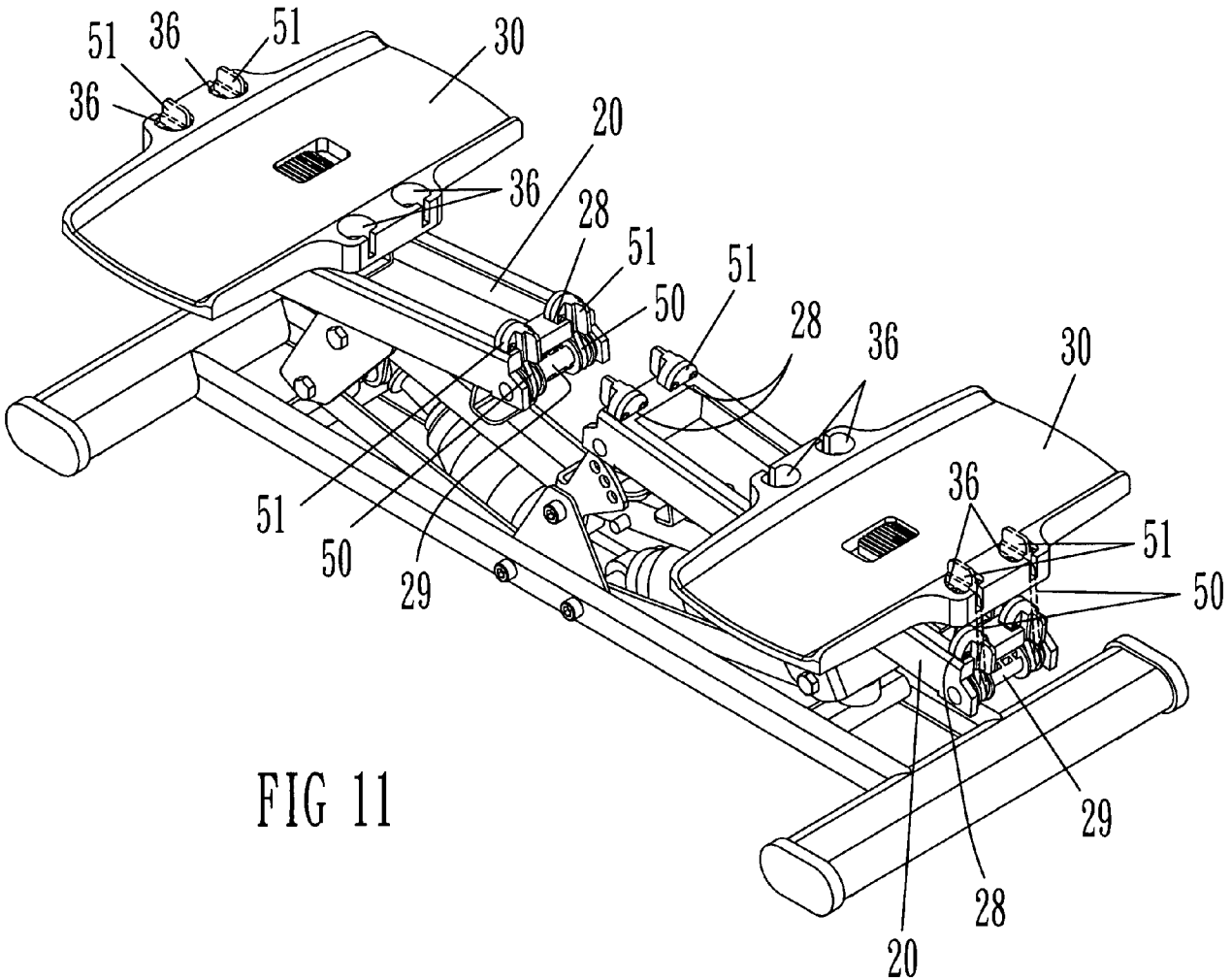
FIG. 11 is a perspective view of another embodiment according to the present invention.
Figure 12:
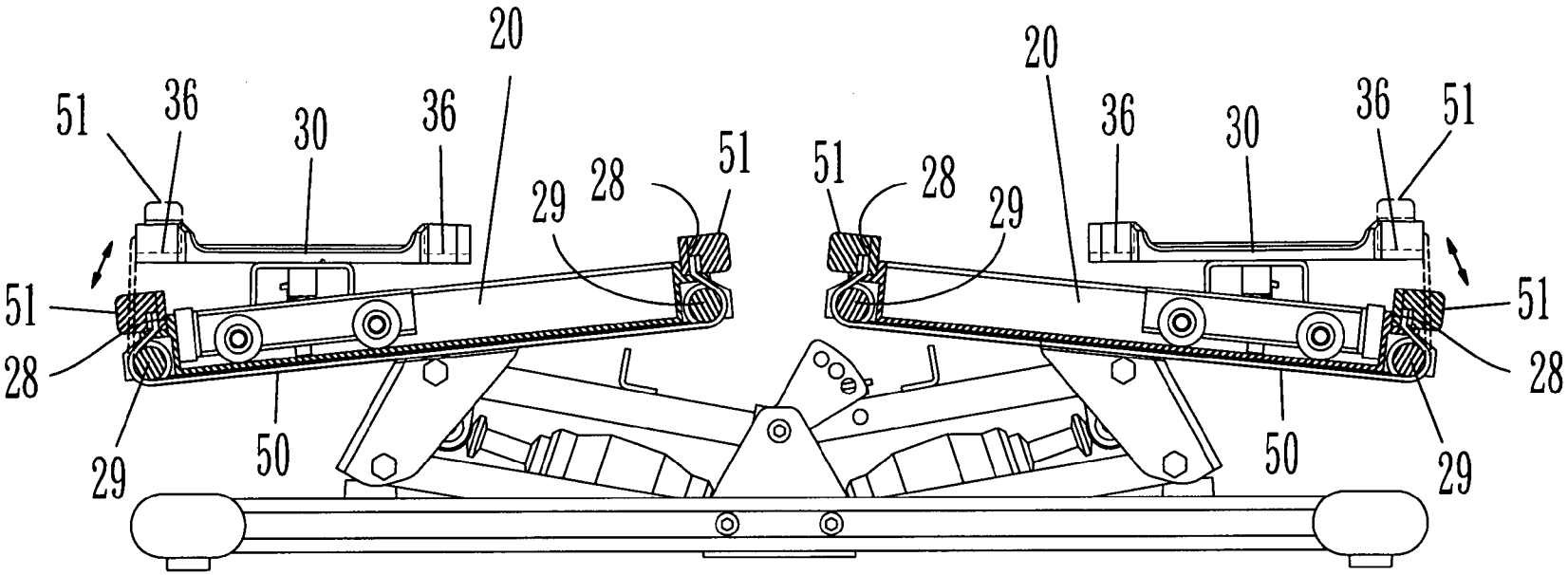
FIG. 12 is a partial front cross sectional view of the embodiment in FIG. 11.

When the present invention is shifted to the feet stretch mode, a device for adding resistance to the pedal is disposed on the present invention. As shown in FIG. 10, FIG. 11 and FIG. 12, at least one set of symmetrical fastening slots 28 is arranged at an outer surface of two short sides of each track groove 20. In this embodiment, each track groove 20 is disposed with two sets of fastening slots 28 and a shaft 29 is disposed under the two adjacent fastening slots 28. At least one elastic band 50 whose number is corresponding to the number of the set of the symmetrical fastening slots 28 is set on the outer surface of the bottom of the track groove 20. One end of the elastic band 50 is connected to a location block, then adhered on, wound around a surface of the shaft 29 on one end of the track groove 20, toward and connected to another location block 51 on the other end of the track groove 20. The location block 51 on one end is fastened and mounted in the corresponding fastening slot 28 of the track groove 20 to be located and held. At least one set of symmetrical locking slots 36 is disposed on two sides of the pedal 30. The number of the set of the symmetrical locking slots 36 is the same with that of the symmetrical fastening slots 28 on the track grooves 20. Thereby as shown in FIG. 11, the location blocks 51 on the outer sides of the two track grooves 20 are moved to be mounted and located in the locking slots 36 on the outer sides of the two pedals 30. Thereby a resistance is provided when the two pedals 30 are moved inward and toward each other. Similarly, the location blocks 51 on the inner sides of the two track grooves 20 can be moved to be mounted and located in the locking slots 36 on the inner sides of the two pedals 30. Thus a resistance is produced when the two pedals are pushed outward.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A multi-function exercise equipment comprising:

a base that is disposed with an upper shaft and two lower shafts;

two track grooves;

a pedal mounted in each of the track grooves and sliding freely therein;

wherein the pedal is disposed with a locking rod that is moved vertically while at least one locating hole is arranged at an inner surface of a bottom of the track groove and the locking rod is mounted into the locating hole; an outer surface of a bottom of one track groove is pivotally connected to a left link and a lower link while an outer surface of a bottom of the other track groove is pivotally connected to a right link and a lower link; the other end of the left link and the other end of the right link are pivotally connected to the upper shaft; the other end of each of the two lower links is pivotally connected to each of the two lower shafts correspondingly; the left link is disposed with at least one stop hole and the right link is arranged with a latch that is matched to the stop hole;

while adjusting and mounting the locking rod into the locating hole and the latch into the stop hole, the two pedals are moved up and down synchronously;

when the locking rod and the latch respectively are released from the locating hole and the stop hole, the pedals are pushed out and returned, sliding in the track grooves.

2. The device as claimed in claim 1, wherein a socket is connected on a bottom of the pedal and a pulley set is pivotally connected to a front part as well as a rear part of the socket; the pulley set having two pulleys that are respectively disposed on two outer sides of the socket and a bottom of the pulley is contacted with an inner surface of the track groove, rolling smoothly therein.

3. The device as claimed in claim 2, wherein an elastic pad is arranged at a front end and a rear end of the socket.

4. The device as claimed in claim 1, wherein a stopping part is disposed on each of two short sides of the track groove and an elastic pad is arranged at an inner side of each stopping part that faces each other.

5. The device as claimed in claim 1, wherein an outer surface of a bottom of the track groove is arranged with an upper shaft and a lower shaft that are respectively pivotally connected to a left link and a lower link; an outer surface on a bottom of the other track groove is disposed with another set of upper and lower shafts that are respectively pivotally connected to a right link and a lower link.

6. The device as claimed in claim 1, wherein a cylinder is disposed between the lower shafts of the base and outer ends of the left and right links.

7. The device as claimed in claim 1, wherein after one end of the latch being released from the stop hole and the left link and the right link being pressed and extended to the maximum, the two track grooves are parallel to a horizontal plane.

8. The device as claimed in claim 1, wherein after one end of the latch is released from the stop hole and the left link and the right link are pushed out to certain positions, the two track grooves are inclined from an inner end of the track groove that faces each other toward an outer end of the track groove.

9. The device as claimed in claim 1, wherein an elastic member is arranged at a top of each of two sides of the base and is used for against an outer surface of a bottom of the track groove.

10. The device as claimed in claim 1, wherein at least one set of symmetrical fastening slots is disposed on each track groove and a shaft is set under the fastening slot; at least one elastic band is set on an outer surface of a bottom of the track groove; the elastic band whose two ends are respectively connected with a location block is wound around the shaft while the location block is fastened and mounted in the corresponding fastening slot; at least one set of symmetrical locking slots is disposed on two sides of the pedal and is for mounting and locating the corresponding location block so as to add resistance to the pedal moved.

* * * * *